United States Patent [19]

Lin

[11] 3,967,961

[45] July 6, 1976

[54] PHOTOELECTROPHORETIC IMAGING PROCESS EMPLOYING A DARK CHARGE INJECTING AGENT - ALKYD RESIN COATING

[75] Inventor: Luke C. Lin, Rochester, N.Y.

[73] Assignee: Xerox Corporation, Stamford, Conn.

[22] Filed: Dec. 4, 1974

[21] Appl. No.: 529,330

[52] U.S. Cl. ..... 96/1.2; 96/1 PE; 204/181

[51] Int. Cl.[2] ..... G03G 17/04

[58] Field of Search ..... 96/1 PE, 1.2, 1.3

[56] References Cited

UNITED STATES PATENTS

| | | | |
|---|---|---|---|
| 3,511,651 | 5/1970 | Rosenberg | 96/1 PE X |
| 3,535,221 | 10/1970 | Tulagin | 96/1.3 X |
| 3,595,771 | 7/1971 | Weigl | 96/1.3 X |
| 3,676,313 | 7/1972 | Ciccarelli | 96/1 PE X |
| 3,689,399 | 9/1972 | Ota | 96/1 PE X |
| 3,689,400 | 9/1972 | Ota et al. | 96/1 PE X |
| 3,767,392 | 10/1973 | Ota | 96/1.3 X |
| 3,804,620 | 4/1974 | Wells | 96/1.3 |
| 3,849,132 | 11/1974 | Wells et al. | 96/1 PE X |
| 3,850,627 | 11/1974 | Wells et al. | 96/1.3 |
| 3,901,701 | 8/1975 | Forest et al. | 95/1 PE X |

OTHER PUBLICATIONS

Kirk and Othmer, *Encyclopedia of Chemical Technology*, Second Edition, 1963, vol. 1, pp. 851–854.

*Primary Examiner*—David Klein
*Assistant Examiner*—John R. Miller
*Attorney, Agent, or Firm*—James J. Ralabate; Michael H. Shanahan; Gaetano D. Maccarone

[57] ABSTRACT

An improved photoelectrophoretic imaging method is disclosed wherein a blocking layer is provided with a coating which interacts, in the dark, with the pigment particles of the imaging suspension so as to provide a uniformly charged imaging suspension upon exposure of the suspension to an electric field. The coating comprises a dark charge injecting agent dispersed in an electrically insulating, alkyd resins derived from dibasic acids and polyhydric alcohols. Subsequent exposure to electromagnetic radiation to which at least some of the particles are sensitive then results in the formation of optically positive and negative images.

23 Claims, 5 Drawing Figures

PHOTOELECTROPHORETIC IMAGING PROCESS EMPLOYING A DARK CHARGE INJECTING AGENT - ALKYD RESIN COATING

BACKGROUND OF THE INVENTION

This invention relates to the photoelectrophoretic imaging process and more particularly to an improved process wherein the imaging suspension is uniformly charged.

A detailed description of the photoelectrophoretic imaging process and materials and apparatus therefore appears in U.S. Pat. Nos. 3,383,993; 3,384,488; 3,384,565 and 3,384,566. The disclosures of the aforementioned patents are hereby incorporated by reference. Briefly, the photoelectrophoretic imaging process, as described in the aforementioned incorporated patents, is a method wherein a liquid suspension of electrically photosensitive particles is placed between a pair of electrodes. The particles acquire a charge when an electrical field is placed between the electrodes which charge is modified by exposure of the particles to light thus causing a light controlled deposition of the particles on one boundary of the suspension or the other. Particle movement is caused by the force exerted on the charged particles by the electric field. The light absorbed by a particle enables it to undergo a change in polarity which then determines its position in the field. One of the electrodes in the process is termed a conductive electrode which is generally a transparent conductive material and is the electrode upon which the pigments desirably rest at the time they are exposed to appropriate electromagnetic radiation. While not subscribing to any particular theory, the aforementioned patents propose that the pigments when exposed to actinic electromagnetic radiation while resting upon the conductive electrode, acquire a charge from the electrode. Upon acquisition of such charge the particle moves toward the opposite electrode. The opposite electrode is generally covered with an electrically insulating material such that when a pigment particle contacts the electrode under influence of the field it will not give up any charge and will remain against the blocking electrode. Upon separation of the electrodes there is generally provided an optically positive image on one of the electrodes and a negative image residing on the other electrode either monochromatic or polychromatic depending upon the optical input and the colors of the pigments in the imaging suspension.

As previously mentioned, the pigments in the imaging suspension have an initial charge and also can acquire an additional electrical charge upon being subjected to an electrical field between the electrodes. One of the problems encountered in the above-mentioned process relates to the polarity of the charge acquired by the pigments of any one color. For example, while about half of certain magenta pigment particles may exhibit a negative charge in the field between the electrodes while in the dark, the other half of the pigment particles will acquire the opposite charge and thus migrate immediately, in the dark, to the blocking electrode. Thus because only some of the pigment resides on the conductive electrode, the density of the resultant image on the conductive electrode is reduced by the amount of pigment deposited on the blocking electrode. Another disadvantage of this phenomenon is the unwanted deposition on the blocking electrode of such pigments in background areas thus degrading image quality of both images produced by the process.

The problem of non-uniform charging of the pigments in the imaging suspension of the photoelectrophoretic imaging method is well known and, in fact, has been employed advantageously in the prior art. For example, a photoelectrophoretic imaging system taking advantage of the diversity of the dark charge of the pigments is disclosed in U.S. Pat. No. 3,535,221, to Tulagin. In accordance with the system disclosed therein the image sense, optical positive or optical negative, is controlled such that one may produce a positive image or a negative image on either of the blocking electrode or the conductive electrode. The method of selectively producing positive or negative copies on either electrode is achieved by providing an imaging suspension with pigment particles having a sensitivity to a first range of wavelengths and providing on the blocking layer surface a photosensitive material sensitive to a second range of wavelengths. In accordance with the disclosure of that patent, an optically positive image is formed on the blocking electrode by exposing the suspension and blocking layer to light in wavelength in which only the coating on the blocking layer is sensitive. If one desires to produce an optically positive image on the conductive electrode one exposes the imaging suspension to electromagnetic radiation to which the particles of the imaging suspension are sensitive but to which the material on the blocking layer is insensitive. The positive image is formed on the blocking layer because of the diversity of charge acquired by the particles of the imaging suspension in the dark. Some of the imaging pigments are attracted to the blocking electrode to form a coating of imaging pigment particles. When the material on the blocking layer is exposed to actinic radiation the pigment particles of the suspension are repelled from the blocking layer in the exposed areas. According to the patent, the coating on the blocking layer reflects back any pigment attracted to it when the coating on the blocking layer is struck with light to which its coating is sensitive. Thus, the light exposed areas will contain no pigment while there will reside on the blocking electrode in non-light struck areas a coating of pigment which has taken an opposite charge to those coating the conductive electrode. When the imaging suspension is exposed with light to which it is sensitive, but to which the coating on the blocking layer is insensitive, the imaging pigments coating the conductive layer are caused to migrate to the blocking electrode in the exposed areas. There is thus produced a positive image configuration of the imaging particles on the conductive electrode.

An even more severe problem exists with polychromatic images produced by the aforementioned process because the loss of varying amounts of pigments of the different colors in this suspension destroys the color balance intended to produce the desired final result.

There has recently been discovered a method whereby all of the pigments of the imaging suspension are uniformly charged thus overcoming the above-mentioned deficiencies. This method involves the coating of the blocking layer with a material which, while in the dark and under the influence of an electrical field, injects charges into the pigments of the imaging suspension. Such materials are termed "dark charge injecting materials" as more fully described below.

Dark charge injecting materials have been coated on the blocking layer by various means such as vacuum depositing an evaporated agent or by painting a liquid dispersion of the agent onto the blocking layer and allowing the liquid to evaporate leaving the agent on the layer. It is also possible to place the agent on the blocking layer by electrophoretic means. However, each method requires cumbersome equipment or extra process steps for the purpose of placing the dark charge injecting agent on the blocking electrode.

In addition, the dark charge injecting material on the blocking electrode has a tendency to transfer from the blocking electrode along with the image produced during the imaging process thus depleting the supply of the dark charge injecting material on the blocking layer and causing unwanted background material on the transferred image.

In an attempt to improve the photoelectrophoretic imaging process which employs dark charge injecting materials on the blocking layer there has been suggested the use of binder materials for the dark charge injecting materials so that they may more permanently reside on the blocking layer. However, such material have included only viscid organic liquids which have been found to be inconvenient for practical use in a commercial machine. Such viscid liquids carry the dark charge injecting material but are slowly eroded with long periods of use in contact with the hydrocarbon liquids normally employed in the imaging suspension of the imaging process.

SUMMARY OF THE INVENTION

Now in accordance with the present invention is an object to overcome the above-noted deficiencies in the prior art photoelectrophoretic imaging process utilizing dark charge injecting agents.

More specifically, it is an object of this invention to provide a photoelectrophoretic imaging process wherein the dark charge injecting agent is conveniently held on the blocking electrode.

Another object of this invention is to provide a photoelectrophoretic imaging process utilizing a dark charge injecting material which is well fixed to the blocking electrode.

Another object of this invention is to reduce the unwanted background material resulting from the transfer of dark charge injecting material from the blocking electrode upon transfer of the image residing on the blocking electrode in the photoelectrophoretic imaging process.

In accordance with this invention, there is provided a photoelectrophoretic imaging process wherein all of the pigments in the imaging suspension are charged, in the dark, prior to the imagewise exposure to a common polarity by means of a dark charge injecting material which is in contact with the imaging suspension. A dark charge injecting material is any material, as further described below, which will inject charge of one polarity into all the pigments of the imaging suspension. The dark charge injecting material need not be photosensitive or if photosensitive it need not be of the same or of different sensitivity of the pigments in the imaging suspension. The reason for the disregard of sensitivity is because the effect of the injection occurs in the dark or, in other words, in the absence of electromagnetic radiation to which either the dark charge injecting layer or imaging suspension is sensitive.

The present discovery is a photoelectrophoretic imaging method employing a dark charge injecting agent on the blocking electrode wherein the agent resides in a binder material comprising a drying or non-drying oil modified alkyd resin derived from dibasic acids, polyhydric alcohols and vegetable oils. The agent is first mixed well in the binder material and then applied to the blocking layer by typical prior art coating means such as doctor blade coating, wirewound rod, rubber roller applicators or extrusion devices. The dark charge injecting agent is found to retain its activity in the photoelectrophoretic imaging process even though it is residing on the blocking layer dispersed in a binder material.

Any suitable drying or non-drying, oil modified alkyd resin can be employed as the binder material in the process of this invention. Such resins are commonly known in the prior art and a more complete description of such materials can be found at pages 853–882 of the Encyclopedia of Chemical Technology Second Edition, 1967, by Kirk and Othmer, hereby incorporated by reference. Although both drying and non-drying oil modified alkyd resins have been found to be useful in the process of this invention, the non-drying resins are preferred. Surprisingly, the drying alkyd resins have been found to be operative only prior to the process of polymerization which normally occurs with such materials as a result of the presence of oxygen at room temperature. Accordingly, the drying alkyd resins are employed either prior to their becoming polymerized or additives are included in the resins to prevent their polymerization. Of course, the non-drying variety has been found to remain active and to adhere well to the blocking layer on which they are coated. The alkyd resins of this invention have been found to be highly durable and conveniently employed in the photoelectrophoretic imaging process.

As is known, such alkyd resins are derived from dibasic acids, polyhydric alcohol and vegetable oils. The most commonly employed dibasic acid is phthalic acid or the anhydride. Other polybasic acids are: phthalic anhydride, isophthalic acid, maleic anhydride, fumaric acid, azelaic acid, succinic acid, adipie acid and sebacic acid.

Typical polyhydric alcohols employed to produce the alkyd resins of this invention are: glycerol, pentaerythritol, dipentaerythritol, trimethylolethane (2-(hydroxymethyl)-2-methyl-1,3-propanediol), sorbitol, trimethylopropane (2-ethyl-2-(hydroxymethyl)-1,3-propanediol), ethylene glycol, propylene glycol, neopentylene glycol (2,2-dimethyl-1,3-propanediol) and dipropylene glycol.

Typical oils employed to modify the alkyd resins in accordance with this invention are: linseed, soya, castor, dehydrated castor, tung, fish, safflower, oiticica, cottonseed and coconut.

The preferred oils and acids of the alkyd resins of this invention are those which have an iodine value of less than about 125 so that a non-drying resin will result. Such oils are cottonseed, peanut, castor, olive and coconut.

In accordance with this invention, the dark charge injecting agent is dispersed in the binder by any suitable mixing method such as milling, stirring, etc. Typically, the dark charge injecting agent comprises from about 1 to about 5 percent, by weight, of the mixture based upon the weight of the binder material. Most typically, the dark charge injecting agent comprises from about 2 to about 3 percent by weight of the binder material. It has been found that the thickness of the dark charge injecting layer according to this invention can vary depending upon the activity of the agent such that more active agents can be employed in thinner layers whereas less active agents are employed in thicker binder layers on the blocking electrode. Typically, the binder layer containing the dark charge injecting agent is coated onto the blocking layer to a thickness of from about 0.5 to about 100 microns thick, although thicker layers can be employed.

Experience with the method of this invention has shown that the polarity injected into the imaging pigments of the imaging suspension by the dark charge injecting material is that polarity which is the same as the blocking electrode. For example, if the blocking electrode has a negative polarity with respect to the conducting electrode the dark charge injecting material will cause the pigments of the imaging suspension to become negatively charged thus causing them to be attracted to the positive conductive electrode prior to the exposure step of the process of this invention.

The materials useful in the process of this invention for the purpose of causing a charge to be injected into the pigments while in the dark condition depends upon the pigments employed in the imaging suspension. Dark charge injecting materials can be classified with respect to their ability to dark charge inject so as to form a Dark Charge Injection Series by an electrometer measurement further described below. In most instances, the dark charge injecting materials in contact with the imaging suspension need only be higher in the series than the pigments employed in the imaging suspension. However, some dark charge injecting agents can be employed wherein the pigments of the imaging layer occupy a substantially equal position in the Dark Charge Injection Series as said agents.

An excess of dark charge injection into the pigments of the imaging suspension in accordance with this invention will decrease the photosensitivity of the pigments. In some cases, the decrease will be to the point of making a reasonable image exposure impractical. To regulate the amount of dark charge injection, one must regulate the amount of dark charge injecting material employed on the blocking layer and if such material is highly active, then the amount is decreased so that the dark charge injection will be adequate to provide a uniformly charged imaging suspension, but will not unduly reduce the photosensitivity of the pigments.

Any candidate material can be placed in the Dark Charge Injection Series by means of a simple test. According to the test, as is more fully described below, the candidate material is coated onto a blocking electrode and mounted on a roller electrode. A thin layer of electrically insulating liquid is spread over a conductive electrode. The electrodes are then connected to a source of electrical potential in the range of about 800 to about 1,000 volts and the roller passed over the conducting electrode at a speed of about 2–5cm-/second. After the roller has passed over the conductive electrode with the potential applied, the amount of charge residing on the candidate material residing on the blocking layer is measured by an electrometer. The amount of charge remaining on the candidate material, expressed as voltage, determines the place the candidate material occupies in the Dark Charge Injection Series. The Series is arranged in terms of such voltage, with each candidate material being placed in the Series immediately above any other material providing a lower voltage in the test and below any other material providing a higher voltage value in the test.

In accordance with the above-mentioned test, there is found in Table I below materials and test results providing an indication of the position of each material in the Dark Charge Injection Series. The test is operated at an applied voltage of 1,000 volts. In general, the amount of dark charge injection increases with the thickness of the layer of candidate material. For illustrative purposes, data is shown below with the same material at three

TABLE I

| Material Tested | Voltage |
|---|---|
| 2,3-dichloro-5,6-dicyano-1,4-benzoquinone | 960 |
| 1-[1-naphthyl azo-]-2-naphthol (1 micron thick) | 900 |
| benzo-[b]-naphtho-[2,3-d] furan-6,11 dione | 750 |
| naphtho [2,3-d] furo-[3,2-f] quinoline-8,13-dione | 560 |
| Bonadur Red B (a pigment available from Collway Colors, Inc.) | 500 |
| naphtho [2,3-d] furo-[2,3-h] quinoline-8,13-dione | 450 |
| 1-[1-naphthyl azo]-2-naphthol (.1 micron thick) | 400 |
| alpha phthalocyanine | 300 |
| dinaphtho [1,2,b; 2',3'd] furan-7,12-dione | 250 |
| dinaphtho [1,2b; 2',3'd] furan-8,13 dione | 100 |
| 1-[1-naphthyl azo]-2-naphthol (.01 micron thick) | 80 |
| Bonadur Red B* | 60 |
| N-2''-pyridyl-8,13-dioxodinaphtho-[2,1-b;2',3-d]-furan-6-carboxamide | 24 |

*The pigment is first dispersed in mineral oil at 4 grams per 100ml. About .8 grams of purified powdered polyethylene DYLT from Union Carbide Corporation is added and dissolved by heating the mixture to 105°C – 110°C. The solution is cooled thus coating the pigment particles with the polyethelene As mentioned above, some dark charge injecting agents can be employed in processes wherein the pigment in the imaging suspension occupies a substantially equal position in the Dark Charge Injection Series as the agent. One way in which to select such materials is to employ a suspension of the candidate material as an imaging layer in the above-described photoelectrophoretic imaging process, with the exception that no exposure of the imaging layer is performed. Upon application of the electrical field, without illumination, the material in the imaging layer will divide and coat both electrodes. A second application of an electrical field is carried out but using a clean blocking electrode. If again the material coats each electrode, it has shown the ability to act as an agent useful in the process of this invention wherein at least one of the pigments in the imaging suspension occupies a substantially equal position in the Dark Charging Injection Series. Typical examples of such materials are: Bonadur Red B, a pigment available from Collway Colors, Inc., alpha phthalocyanine, 1-[1-naphthyl azo]-2-naphthol, benzo-[b]- naphtho-[2,3-d] furan-6,11-dione and dinaphtho [1,2,d; 2'3';d] furan-8,13-dione.

Although this invention has been described with respect to the photoelectrophoretic imaging process, it is equally applicable to the electrophoretic imaging process. Because the dark charge injection does not require actinic electromagnetic radiation the electrophoretic imaging process can be advantageously employed with a dark charge injecting material on the blocking layer. Thus, typical prior art electrophoretic systems incorporating the dark charge injecting materials as described herein with respect to the photoelectrophoretic imaging process is within the scope of this invention.

BRIEF DESCRIPTION OF THE DRAWINGS

The invention may be further understood uponreference to the drawings which show a schematic representation of apparatus for performing the improved photoelectrophoretic imaging process of this invention.

FIG. 4(*b*) is a graphical representation of data acquired by employing the system of FIG. 4(*a*).

DETAILED DESCRIPTION OF THE DRAWINGS

Figure 1:
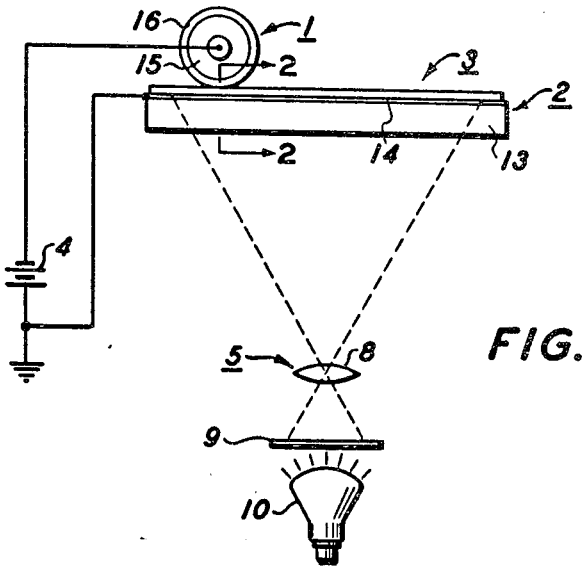
FIG. 1 is a schematic, side elevation view of a photoelectrophoretic imaging system.

FIG. 1 illustrates a conventional configuration for a photoelectrophoretic imaging system which includes the roller electrode 1, transparent conductive electrode 2 and the imaging suspension 3 containing photosensitive pigment particles. An electric field is established across the suspension in the vicinity of the electrode nip by an appropriate electrical energy source 4. The suspension is exposed by the exposure mechanism 5 to radiation to which the electrically photosensitive pigments in the imaging suspension are sensitive. Mechanism 5 includes the lens 8 which focuses a light image of the original image 9 through the transparent injecting electrode 2 onto the suspension. An appropriate light source 10 generates the electromagnetic radiation. Typically, a full frame positive image is formed on the conductive electrode 2 and a full frame optically negative image is formed on the blocking electrode, roller electrode 1. By rolling the blocking roller electrode 1 across the imaging suspension 3, the image is formed in a line by line fashion as the roller electrode rotates and translates over the transparent electrode while the light and field are applied.

Typically, the transparent conductive electrode 2 includes an optically transparent glass plate 13 coated on the imaging suspension side with an optically transparent layer of conductive material such as a thin layer of tin oxide. Electrodes of this type are typically termed "injecting electrodes" because the conductive layer provides an abundant source of charge carriers for exchanging charge with exposed photosensitive pigment particles of the imaging suspension. The roller blocking electrode 1 includes a conductive core 15 overcoated with a layer 16 of electrically insulating material. Electrodes of this type are typically termed "blocking electrodes" because the insulating layer provides few if any charge carriers for exchanging charge with photosensitive pigment particles residing thereon. The insulating layer 16 may be eliminated and photoelectrophoresis will still occur but its presence insures against electrical shortage between the electrodes in addition to improving image quality. Also, the transparent injecting electrode 2 may also be provided with a transparent electrically insulating layer over the tin oxide surface immediately adjacent the imaging suspension because charge carriers can be made available to the exposed electrically photosensitive pigment particles fully in accordance with the prior art.

Figure 2:
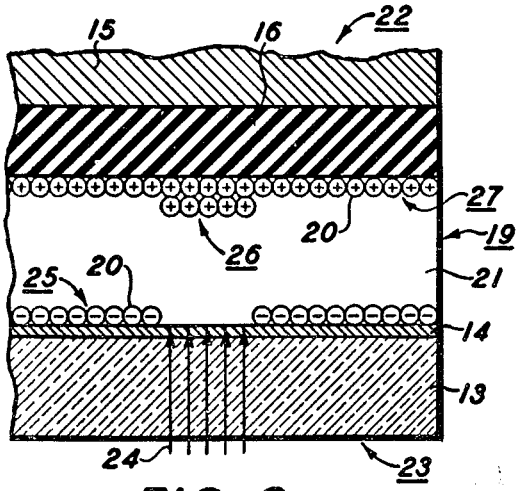
FIG. 2 is a schematic, sectional view in exaggerated proportions taken along lines 2—2 in FIG. 1 and illustrated the dark and light charged condition of prior art photoelectrophoretic systems.

FIG. 2 illustrates the light induced image forming process of an exposed imaging suspension subjected to an electric field in accordance with the prior art. It should be understood that this and the other drawings are intended to convey a functional understanding of the photoelectrophoretic process and the present invention. The physical models represented in the drawings are directed to that and are not intended to be theoretical explanations of the physical and chemical mechanisms involved. The relative sizes of the electrodes, imaging suspension and pigment particles therein are not to scale but are greatly exaggerated. The above mentioned and incorporated patents may be consulted for greater detail in that regard. For example, the usual particle size in the imaging suspension is from about 0.01 to about 20 microns and the gap between the electrodes occupied by the suspension is typically in the order of about 1 mil.

Suspension 19 in FIG. 2 includes the bipolar, electrically photosensitive pigment particles 20 and an electrically insulating liquid 21. The electric field established between electrodes 22 and 23 causes the positively charged pigment particles in the imaging suspension to be attracted toward electrode 22, which in this instance is taken to be negatively charged with respect to electrode 23. The negatively charged particles are thus attracted toward positively charged electrode 23. The amount or number of pigments attracted to the electrodes vary depending upon the nature, purity and type of pigments in the imaging suspensions. Although the distribution of particles is indicated to be approximately equal, such may not be the case in most instances. However, in many imaging suspensions of the prior art there are significantly high numbers of pigment particles which have too low a charge or are of the wrong polarity and hence are either not attracted at all or attracted to the blocking layer. The number is sufficiently high so as to substantially reduce the density of the particle layer on the conductive electrode 23. Lines 24 represent electromagnetic radiation of an image directed through transparent electrode 23 to the negatively charge pigment particle layer 25. Negative particles absorbing the radiation lose their excess charge and/or negative charge carriers to become positively charged and are thus attracted in the electric field toward negative electrode 22. The migrated particles 26 comprise an optically negative image of the original and the particles remaining on electrode 23 comprise an optically positive image of the original image. It is apparent from FIG. 2 that the pigment particles forming layer 27 on the blocking electrode 22 have remained there from the inception of the electrical field which attracted them. They remain there completely unaffected by the imaging operation. Thus, at least two disadvantages of their presence in layer 27 are evident. First, they deprive the positive image of their contribution in terms of color balance on the polychrome system and in both monochrome and polychrome they deprive the positive image on electrode 23 of their contribution toward the density of the resulting image. Secondly, layer 27 provides unwanted background particles on the negative image residing on the blocking electrode 22. Such background is undesirable as it detracts from the qualities of the images thus produced.

Prior attempts at eliminating layer 27 included separating the steps of forming particle layer 25 and exposing the layer. That is, a second blocking electrode roller having a clean surface is passed over layer 25 so that particles 26 are deposited on a particle-free surface. The problem with this technique is that the particles in layer 25 are not always stable and/or bipolar particles are still present in sufficient quantities to form a particle layer similar to layer 27 on the clean roller surface. Obviously, an undesired second step us required in the prior art and the inefficient use of materials must be tolerated.

Figure 3:
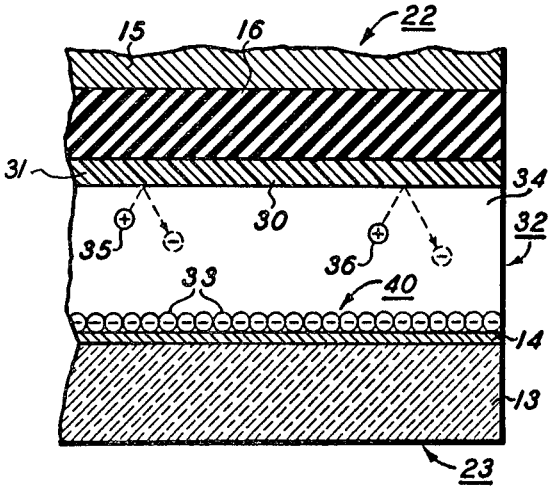
FIG. 3 is a schematic, sectional view in exaggerated proportion taken along lines 2—2 in FIG. 1 further including a dark charge injecting material on the blocking electrode in accordance with the process of this invention.

FIG. 3 illustrates a process of the present invention wherein the dark charge injecting material 20 resides in layer 31 which is an oil modified alkyd resin of the type described above. As explained previously, the application of an electric field between electrodes 22 and 23 causes the pigment particles of an imaging suspension to be attracted toward the electrode of opposite polarity to the charge acquired by the various pigment particles. Thus, layer 40 is formed on conductive electrode 23 which is charged positively with respect to electrode 22 in the electrical field. The positively charged pigment particles of imaging suspension 32 are attracted toward negatively charged electrode 22. In FIG. 3 these are illustrated as particles 35 and 36 which upon coming in contact with the dark charge injecting material 30 contained in layer 31 become negatively charged and are thus attracted toward electrode 23 leaving the blocking layer free of imaging pigment particle deposits. As mentioned above, the dark charge injecting material causes the pigment particles to acquire a charge of the same polarity as the electrode upon which the dark charge injecting material resides. The mechanism by which the dark charge injecting material operates on the imaging pigments 35 and 36 is not understood. Surprisingly, the presence of the unpolymerized, oil modified alkyd resin of layer 31 does not inhibit the action of the dark charge injecting material. The actual charge exchange mechanism is not presumed to be explained herein. Regardless of the mechanism involved, the positively charged particles become negative and join the originally negatively charged particles initially attracted to a transparent conductive electrode 23 to form layer 40. Ideally, all the particles in the suspension are attracted into and form layer 40 thereby increasing the potential maximum optical densities for the optical positive and negative images to be formed in the photoelectrophoretic imaging process. In addition, uniform deposition of the pigment particles increases the efficiency of the materials employed in the process and the color balance of a polychrome system is more easily achieved because one need not anticipate the loss of various amounts of differently colored pigments from the final image due to the erratic nature of charge acquisition of any one colored pigment in the imaging suspension. The amount of pigments in the imaging suspension can actually be reduced by about 20 percent to about 30 percent, by weight, below previous concentrations because of the increase in efficiency of pigment use in accordance with this invention.

Layer 40 is exposed in the conventional fashion as explained above with respect to the prior art photoelectrophoretic processes. A negative image is formed by particles attracted toward electrode 22 because of the action of appropriate electromagnetic radiation to which they are exposed as shown in FIG. 2. Of course, the negative image thus produced on electrode 22 does not contain undesirable background particles and the positive image remaining on electrode 23 benefits from the increased density otherwise lost by the previously positively charged pigment particles of the imaging suspension.

As explained above, most materials useful as dark charge injecting material 30 are those materials which have a higher place in the Dark Charge Injection Series than any of the pigments employed in the imaging suspension. The choice of such materials is thus independent of properties such as their relative spectral sensitivity with the pigment particles of the imaging suspension. In fact, it has been found that such materials may comprise pigment particles which are also employed in imaging suspension 32. In addition, dark charge injecting materials can comprise materials which previously have been recognized as not possessing any electrically photosensitive properties and previously useless in prior art photoelectrophoretic imaging processes. The usefulness of any material can be easily determined by the above described secondary test which places the material in the Dark Charge Injection Series. In accordance with the above-described secondary test a material which measures in the range of from about 200 volts to about 900 volts is normally satisfactory for use with most commonly available pigments in the imaging suspension of the photoelectrophoretic imaging process. Of course, the purity of a material may affect its activity as a dark charge injecting agent and care should be taken to provide reasonably uncontaminated materials.

Figure 4A:
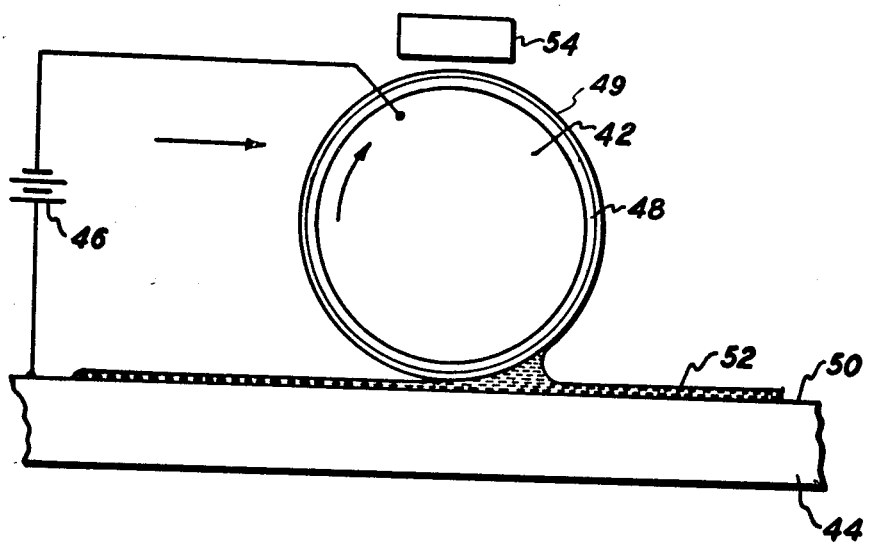
FIG. 4(*a*) is a schematic, side elevation view of a test system employed to place materials in the Dark Charge Injection Series.
Figure 4B:
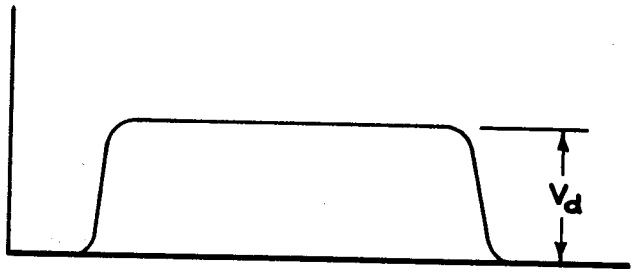

As mentioned above, the Dark Charge Injection Series can be determined by a secondary test. In FIG. 4(*a*) there appears a schematic side elevation view of one system employed to place materials in the series. A pair of electrodes, roller electrode 42 and conductive electrode 44, are connected to power source 46. Electrode 42 is coated with an electrically insulating blocking layer 48 which, in turn, carries a thin layer of the candidate material 49. Layer 49 is shown in expanded form and actually is a very thin layer as described above. The candidate material is employed in this test without the use of binder material such as the oil modified alkyd resins described herein above. Liquid layer 52 is placed between blocking layer 48 and electrode 44. With the electric field placed between the electrodes, roller electrode 42 passes over liquid layer 52 while the system is in the dark. The candidate material on blocking layer 48 passes between the electrodes and is thus subjected to the above mentioned electric field while in the dark. Without offering any theoretical explanation, the candidate material will carry an electric charge subsequent to being subjected to the electric field as described above. The amount of charge, expressed in volts, is measured by an electrometer or electrostatic voltmeter probe 54.

In FIG. 4(*b*) is presented a graphical representation of the charge measured by probe 54. The ordinate indicates voltage measured and the abscissa indicates circumferential distance of the candidate material on blocking layer 48. As shown in FIG. 4(*b*) the amount of voltage $V_d$ indicates the dark injection voltage of the candidate material.

Any suitable material can be placed in the Series. The electrometer test described above is utilized by first coating a blocking material to a suitable thickness with a candidate material. The most preferred blocking material is Tedlar, an aluminized polyvinyl fluoride available from the E. I. DuPont de Nemours & Co., Inc., the coated blocking material is utilized as the blocking electrode in a roller configuration which can take the form of the system of FIG. 4(*a*). The insulating liquid layer 52 is free of any pigment particles and can be any liquid previously known to be useful in the prior art photoelectrophoretic imaging system. A kerosene fraction, Sohio Odorless Solvent 3440 available from the Standard Oil Co., is the preferred electrically insulating liquid. The configuration comprising the coated blocking electrode 48, the clear liquid layer 52 and conductive electrode 44 is subjected to an electrical potential of about 1,000 volts. If the apparatus of FIG. 4(*a*) is employed, the roller blocking electrode traverses the conductive electrode at a rate of about 2–5 cm/second. The configuration is maintained in the dark condition while the electric potential is applied. The change, in voltage, as measured on the coated blocking layer is detected by electrostatic voltmeter 54 as the roller electrode 42 travels across conductive electrode 44. The amount of voltage measured determines the place the candidate material occupies in the Dark Charge Injection Series.

The most reliable results are obtained in the above test when the dark charge injecting material is condensed on the blocking layer 48 after having been evaporated in a suitable vacuum chamber. Any method of coating such as electrophoretic deposition, solution coating and dip coating can be employed. As a general rule, materials in the Dark Charge Injection Series will inject charge, in the dark, while subjected to an electric field into any material lower in the series. Thus, in accordance with this invention, the dark charge injecting material employed on the blocking layer will be higher in the series than any of the pigments employed in the imaging suspension of the photoelectrophoretic imaging process.

Through experience, the dark charge injection capability of any particular material has been found to be somewhat affected by the time duration of the electric field, the thickness of the dark charge injecting material coating on the blocking layer and the magnitude of the electric field. Generally speaking, the duration of the electric field will give some increase in the amount of dark charge injection but such duration does not appear to be affected in time durations of greater than 1 second. A duration of from $10^{-6}$ seconds to $10^{-1}$ second tends to increase the amount of dark charge injection. In most instances, the thickness of the dark charge injecting layer on the blocking electrode is in the range of from about 0.01 to about 10 microns, although other thicknesses can be employed. In general, the amount of dark charge injection increases with increasing thickness but above about 10 microns the amount of dark charge injection increase is small. While it has been found that the amount of the applied field increases the amount of dark charge injection, the amount of injection is generally sufficient for purposes of the photoelectrophoretic imaging process in the range of from about 100 to about 1,000 volts per mil although other fields can be employed. In actual practice, the operating conditions of the above-described test are held constant to provide reproducable and comparable results.

DESCRIPTION OF THE PREFERRED EMBODIMENTS

The following examples further specifically define the present invention. Parts and percentages are by weight unless otherwise indicated. The examples are intended to illustrate various preferred embodiments of the process of this invention.

All of the following examples are carried out in an apparatus of the general type illustrated in FIG. 1 with the imaging suspension being coated on the conductive surface of a NESA glass electrode connected in series with a switch, a potential source and a conductive center of a blocking electrode. The roller is about 2½ inches in diameter and is moved across the plate surface at about 4 cm/second. The conductive electrode employed is roughly a 4 inch square section of NESA glass and is exposed with an unfiltered white light intensity of about 200 microwatts/sq.cm. as measured on the uncoated NESA glass surface. Unless otherwise indicated about 7 percent by weight of the indicated pigments in each example is suspended in Klearol, a mineral oil available from Witco Chemical Co., N.Y., N.Y., to form the imaging suspension. Exposure is made with a 3200°K lamp through a transparent photographic original while a potential of 2 KV is applied between the electrodes. The dark charge injecting layer has a thickness on the blocking electrode in the range of about 0.05 to about 0.1 micron unless otherwise stated.

EXAMPLE I (Prior Art)

An imaging suspension is prepared by adding alpha-phthalocyanine to the imaging liquid and coating the suspension onto the surface of a NESA glass electrode. While being exposed imagewise, a blocking electrode is rolled over the suspension with each electrode being connected to a 2,000 volt power supply, the NESA electrode having a positive polarity with respect to the blocking electrode. The blocking material on the roller comprises a 2 mil thick Tedlar film. A positive image having low density is found on the NESA electrode while a low quality negative image having high background is found on the blocking layer.

EXAMPLE II

1 Part of a dark charge injecting material, Bonadur Red B pigment is added to about 50 parts of Duraplex D-65A, an oil modified, alkyd resin available from Rohm and Haas Chemical Co. After thorough mixing to assure uniform dispersion, the dispersion is coated onto a Tedlar film similar to that of Example I through the use of a small rubber covered roller. The procedure of Example I is repeated with the exception that the coated Tedlar film is employed as the blocking electrode thus placing the imaging suspension in contact with the coated side of the film. A very high density positive image is found on the NESA electrode while an exceptionally high quality negative image is found on the blocking layer. Upon transfer of the image on the blocking layer in accordance with known prior art means a substantially background free image is found on the transfer sheet substantially free of Bonadur Red B pigment.

EXAMPLE III

The procedure of Example II is repeated with the exception that the dark charge injecting material dispersed in the alkyd resin is 1-[1-naphthyl azo]-2-naphthol. Similar results are obtained.

EXAMPLE IV

Into about 50 parts of Duplex Alkyd ND 76, a commercial product containing coconut oil available from the Rohm and Haas Chemical Co., there is dispersed by ballmilling 4 parts of Bonadur Red B pigment. The dispersion is then coated onto a Tedlar film similar to that employed in Example I by means of a doctor blade to a thickness of about 2 microns. A trimix is then prepared by combining substantially equal amounts of Bonadur Red B having polymer added as described in Table I, yellow pigment, N-2″-pyridyl-8,13-dioxodinaphtho-(2,1-d;2′,3-d)-furan-6-carboxamide) and alpha phthalocyanine. The mixture appears substantially black and is coated on the conductive surface of a NESA glass electrode. A full color transparency is projected onto the imaging layer while a roller electrode carrying the blocking layer with the alkyd coating in contact with the imaging suspension is rolled across the NESA electrode. A full color, optically positively image is thus produced on the NESA electrode while an optically negative image in the original is found on the coated blocking electrode. The images are found to have improved maximum and minimum density and contrast while flesh tones are greatly improved. The optically negative image on the blocking electrode is transferred by electrostatic means of the prior art and the transfer image is found to be substantially free of Bonadur Red B pigment in the background areas.

EXAMPLE V

About 3 parts of 1-[1-naphthyl azo]-2-naphthol is dispersed in about 97 parts of Duplex Alkyd ND 77B a commercial product available from the Rohm and Haas Chemical Co. A thin layer of the dispersion is applied to a Tedlar film by means of a rubber roller. The coated Tedlar fim is then employed in an imaging procedure as described in Example I. A high density positive image is procedure on the NESA electrode while a low background, dense negative image is formed on the blocking electrode.

EXAMPLE VI

A compounded rubber composition is prepared by milling the following compositions in the amounts indicated below as parts by weight on a two roll rubber mill until a uniform composition is obtained:

| | |
|---|---|
| acrylonitrile rubber No. 1001 (available from B.F. Goodrich Rubber Co.) | 227 |
| stearic acid | 2.3 |
| zinc oxide | 11.4 |
| barium titanate | 545 |
| Bonadur Red B pigment | 136 |

-continued

| | |
|---|---|
| tetramethylthiuram disulfide | 8 |

A roller electrode is constructed by covering a conductive core with a layer of the composition to a thickness of about 0.040 inch. The coated electrode is employed in the photoelectrophoretic imaging method as described in Example IV. Images of improved density and background are obtained. The electrode retains the dark charge injecting material for repeated usage.

Exemplary dark charge injecting materials which can be employed in the photoelectrophoretic imaging process according to this invention are:

Indofast Yellow Toner (availble from Harmon Color Co.), naphtho [2,3-d] furo-[3,2-f] quinoline-8,13-dione, Rhodamine B (ionic dye), benzo-[b]-naphtho-[2,3-d] furan-6, 11-dione, same, Rhodamine B (ionic dye), Indofast Yellow Toner, 1-[p-nitrophenyl azo]-2-naphthol, hexadecyl amine, hexadecyl amine hydrochloride, hexadecyl trimethyl ammonium chloride, p-nitrophenol, hexadecyl alcohol, p-dimethylaminoazobenzene, Erythrosine Yellowish $C_{20}H_8I_2Na_2O_5$, potassium iodide, lithium bromide, lithium chloride, ferrous chloride, dodecylethylmethylsulfonium chloride, hexadecyltrimethyl-ammonium chloride, polyvinylbenzyl trimethyl ammonium, alkyl aryl sulfonate (Atlas G3300) (available from Atlas Chemical Co.), N-cetyl-n-ethyl morpholinium ethosulfate (Atlas G263), dodecyl-phenol ethylene oxide adduct (Monsanto Sterox DF) available from Monsanto Co., dodecyl phenol, arginine, 8-hydroxy quinoline, benzotriazole, carbon black and cobalt neodecanoate.

Although specific components and proportions have been stated in the above description of preferred embodiments of the invention, other typical materials as listed above if suitable may be used with similar results. In addition, other materials may be added to the mixture to synergize, enhance or otherwise modify the properties of the imaging layer. For example, various dyes, spectral sensitizers such as Lewis acids may be added to the several layers.

Other modifications and ramifications of the present invention will occur to those skilled in the art upon a reading of the present disclosure. These are intended to be included within the scope of this invention.

What is claimed is:

1. A photoelectrophoretic imaging process comprising the steps of providing an imaging layer comprising a suspension of electrically photosensitive pigment particles in an electrically insulating carrier liquid placed between an electrically conductive electrode and a blocking electrode, said conductive electrode being at least partially transparent to electromagnetic radiation to which at least a portion of said pigment particles are sensitive and said blocking electrode being coated with a dark charge injecting agent, said agent being dispersed in a binder of an unpolymerized, electrically insulating, oil modified alkyd resin, wherein said dark charge injecting agent coating on said blocking electrode is capable of causing said pigment particles to be substantially uniformly attracted to said conductive electrode when an electrical field is applied across said suspension in the dark, subjecting said suspension to an electrical field established between said conductive electrode and said blocking electrode in the dark while in contact with said dark charge injecting agent containing binder whereby said pigment particles are substantially uniformly attracted to said conductive electrode, and during said electrical field application exposing said suspension to electromagnetic radiation to which at least a portion of said pigment particles are sensitive until an image is formed.

2. The process of claim 1 wherein said imaging suspension comprises particles of pigments of at least two colors and having different spectral sensitivity.

3. The process of claim 1 wherein said imaging suspension comprises particles of three different electrically photosensitive pigments each pigment being responsive to a different wavelength of electromagnetic radiation.

4. The process of claim 1 wherein the imaging suspension includes cyan colored particles which are principally photosensitive to red light, magenta colored particles which are principally photosensitive to green light, and yellow colored particles which are principally photosensitive to blue light.

5. The process of claim 1 wherein said dark charge injecting agent is dispersed in a binder material which comprises an unpolymerized, non-drying, oil modified alkyd resin.

6. The process of claim 5 wherein said binder material is derived from phthalic anhydride and pentaerythritol.

7. The process of claim 1 wherein said binder is derived from phthalic anhydride and glycerine.

8. The process of claim 5 wherein said oil is peanut oil.

9. The process of claim 7 wherein said oil is peanut oil.

10. The process of claim 5 wherein said oil is castor oil.

11. The process of claim 5 wherein said oil is olive oil.

12. The process of claim 5 wherein said oil is coconut oil.

13. The process of claim 5 wherein said oil is cottonseed oil.

14. The process of claim 1 wherein the binder layer is in the range of from about 0.5 micron to about 100 microns in thickness.

15. The process of claim 5 wherein the charge injecting agent is Bonadur Red B.

16. The process of claim 1 wherein the dark charge injecting agent is 1-[1-naphthyl azo]-2-naphthol.

17. The process of claim 1 wherein said dark charge injecting agent is Bonadur Red B.

18. The process of claim 1 wherein the imaging suspension is exposed to an optically negative image thereby providing an optically positive copy on said blocking electrode.

19. The process of claim 18 wherein said imaging suspension comprises particles of three different electrically photosensitive pigments, each pigment being responsive to a different wavelength of electromagnetic radiation.

20. The process of claim 18 wherein the imaging suspension includes cyan colored particles which are principally photosensitive to red light, magenta colored particles which are principally photosensitive to green light, and yellow colored particles which are principally photosensitive to blue light.

21. The process of claim 18 wherein the dark charge injecting agent is 1-[1-naphthyl azo]-2-naphthol.

22. The process of claim 1 wherein said dark charge injecting agent comprises from about 1 percent to about 5 percent by weight of said coating on said blocking electrode.

23. The process of claim 5 wherein said dark charge injecting agent comprises from about 1 percent to about 5 percent by weight of said coating on said blocking electrode.

* * * * *